United States Patent [19]

Larson

[11] Patent Number: 4,815,240

[45] Date of Patent: Mar. 28, 1989

[54] HAND-HELD SKATE SHARPENER

[76] Inventor: Clifford M. Larson, 391 Illinois Blvd., Hoffman Estates, Ill. 60194

[21] Appl. No.: 166,668

[22] Filed: Mar. 11, 1988

[51] Int. Cl.[4] ..... B23F 21/03

[52] U.S. Cl. ..... 51/205 WG; 51/214

[58] Field of Search ..... 51/204, 205 R, 205 WG, 51/211 R, 211 H, 214, 181 R

[56] References Cited

U.S. PATENT DOCUMENTS

| | | | |
|---|---|---|---|
| 1,818,870 | 8/1931 | Rice | 51/205 WG |
| 2,092,831 | 9/1937 | Cannon | 51/205 WG |
| 3,670,459 | 6/1972 | Welton | 51/181 R |
| 4,509,297 | 4/1985 | Lindgren | 51/181 R |

FOREIGN PATENT DOCUMENTS

| | | | |
|---|---|---|---|
| 265919 | 12/1946 | Canada | 51/205 WG |

*Primary Examiner*—Frederick R. Schmidt
*Assistant Examiner*—Blynn Shideler
*Attorney, Agent, or Firm*—Wallenstein Wagner Hattis & Strampel

[57] ABSTRACT

A hand-held ice skate blade sharpening device consists of a holder that has first and second exposed slots extending from opposite edges or surfaces thereof and the exposed slots have a common surface for receiving the sharpening element in extended engagement thereof. The sharpening element has a generally convex surface exposed within the first slot and has a generally flat surface exposed in the second slot so that the device can be utilized not only for sharpening the cutting edges of an ice skate blade, but also can be used as a deburring device for removing burrs from opposed walls of the ice skate blade.

7 Claims, 1 Drawing Sheet

FIG. 1.
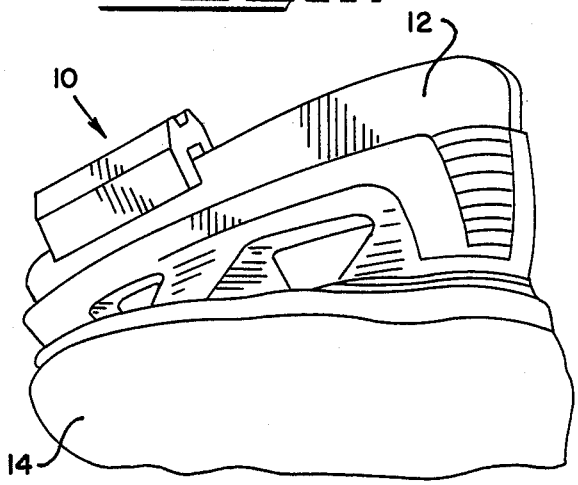
FIG. 2.
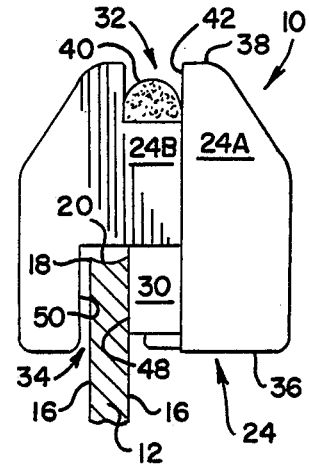
FIG. 3.
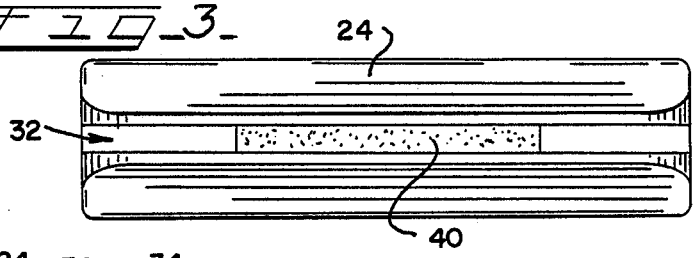
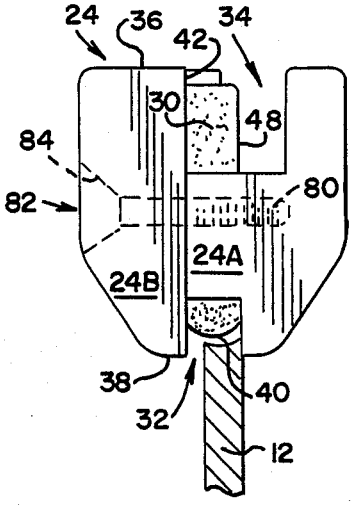
FIG. 4.
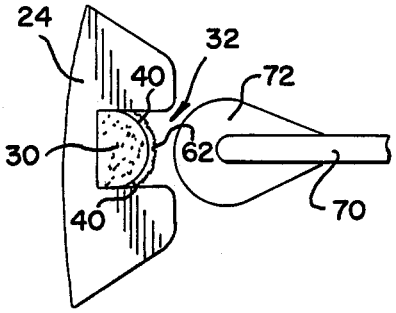
FIG. 5.

HAND-HELD SKATE SHARPENER

DESCRIPTION

1. Technical Field

The present invention relates generally to sharpening devices and, more particularly, to a hand-held sharpening device which is utilized for sharpening the edges of an ice skate blade and, at the same time, providing a deburring device for cleaning the surfaces adjacent the cutting edges of the ice skate blade.

2. Background Prior Art

Numerous devices have been proposed in the past number of decades for the sharpening of ice skates utilizing hand-held tools.

Exemplary of the prior art type of devices are disclosed in U.S. Pat. Nos. 522,994 issued to Lynch; 750,696 issued to Price; 2,042,916 issued to Viozzi; 2,542,281 issued to Lefteruk; 3,585,880 issued to Kabriel; and, 4,219,975 issued to Scholler.

The Lynch patent discloses a device for sharpening skate runners and consists of a holder which supports a file that is generally rectangular in cross-section and has a convex surface on one edge and a generally planar surface on an opposite edge. The file is held or clamped within the holder utilizing a screw so that either the planar or the convex surface edges of the file may be exposed within a slot for sharpening a runner of an ice skate.

Price discloses a skate sharpener that includes a holder that consists of two members which are interconnected and define an open slot therebetween into which a cutting tool is exposed and which receives the blade of the ice skate. In the respective embodiments illustrated, the cutting tool can either have a convex exposed surface, a circular exposed surface, a triangular exposed surface or a flat surface.

Lefteruk discloses an ice skate sharpener that consists of a body that supports a honing element within a slot and has rollers for guiding the skate blade along the honing surface of the housing element. A spring-biased ball engages a surface of the blade to force the blade into engagement with the rollers and the honing surface is either flat or convex.

Kabriel discloses a hand-held ice skate sharpening device that includes a main body that defines an elongated opening slot which has a first cutting insert located at the end of the slot and a second cutting insert located along one surface of the slot. The respective cutting inserts are located perpendicular to each other to define perpendicular sharpening surfaces for the ice skate blade.

Scholler discloses a hand-held sharpening blade that consists of a generally cylindrical sharpening element that is mounted within a holder that has a slot for receiving the blade. Thus, the blade has a concave surface which engages the cylindrical surface of the sharpener element.

Thus, there are a number of devices that have been proposed for the sharpening of the cutting edges of a blade, but none of these devices have universal applicability in not only sharpening opposite cutting edges on the end of the blade but also providing a deburring mechanism for the side walls of the blade extending upwardly from the cutting edges.

SUMMARY OF THE INVENTION

According to the present invention, a universal sharpening device has been provided which consists of a holder that can be conveniently grasped within the hand of a user and provides a dual function of sharpening the cutting edges, as well as providing a deburring function for the side wall surfaces of an ice skate blade.

The general environment to which the present invention is particularly adapted consists of an ice skate blade that has opposed outer walls terminating at one end into cutting edges that are defined by a generally concave surface between the opposed walls. The hand-held sharpening device of the present invention consists of a generally rectangular holder that has a pair of exposed slots located or extending from opposite edges of the hand-held device with a common sharpening element received into the device and exposed in the respective slots.

More specifically, the holder or non-metallic elongated member has a first slot extending from one edge that is closed at an opposite edge and communicates with a second slot defined on the opposite edge. The sharpening element consists of a generally rectangular member that has a generally convex surface along one edge thereof, which is exposed in the first slot, and has generally parallel planar surfaces extending from the convex surface, with one of the surfaces being exposed in the second slot. The respective slots are dimensioned such that the first slot is slightly wider than the width of the ice skate blade that is to be sharpened. The second slot is dimensioned to receive the width of the sharpening element and defines an exposed slot that has a width which is slightly wider than the thickness of the blade that is to be sharpened.

Thus, the convex sharpening surface of the sharpening element is exposed in the first slot for producing a clear sharpening surface for sharpening the cutting edges of the respective sides of the ice skate blade, while a flat generally planar surface is exposed in the second slot for removing any burrs from the side walls of the ice skate blade.

BRIEF DESCRIPTION OF DRAWINGS

FIG. 1 is a perspective view of the bottom portion of an ice skate showing the blade and the sharpening element in conjunction therewith;

FIG. 2 is an end view of the hand-held sharpening member showing the ice skate blade in conjunction with the sharpening member;

FIG. 3 is a bottom view of the hand-held sharpener shown in FIG. 1;

FIG. 4 is an end view showing the sharpener as used in connection with the sharpening of the edges of the ice skate blade; and, FIG. 5 is a view similar to FIG. 4 showing the cleaning mechanism for cleaning the sharpening member.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to embodiments illustrated.

FIG. 1 of the drawings shows a hand-held ice skate sharpening device, generally designated by reference numeral 10, disclosed in connection with an ice skate blade 12 that forms part of a shoe 14. As shown in FIG. 2, the ice skate blade 12 has opposed generally parallel side walls 16 that terminate at its ends into cutting edges 18 with a generally concave surface 20 located between the cutting edges 18.

The sharpening device 10 consists of a generally non-metallic holder 24 that includes first and second portions 24A and 24B that are preferably interconnected, such as by gluing. The holder 24 defines a pair of slots 32 and 34 extending from opposite exposed surfaces 36 and 38 with a sharpener element 30 received into the slots. The first slot 32 has a width that is greater than the width of the ice skate blade 12 and the sharpening element 30 has a convex exposed surface 40 located within the slot 32.

The second slot 34 is substantially wider than the first slot 32 and the two slots have a common wall 42 defining one edge of the respective slots 32 and 34. As more clearly shown in FIG. 4, the width of the slot 32 is greater than the thickness of the ice skate blade 12 to be sharpened and, thus, exposes a convex surface 40 for engagement with the respective ends of the concave surface of the skate blade 12. Thus, the skate blade 12 may have a first surface or side wall 16 engaging one wall of the slot 32 to sharpen the cutting edge 18 located adjacent the opposite wall 16, as shown in FIG. 4, and alternatively can have the opposite cutting edge 18 sharpened by engaging the second wall 16 with the opposite exposed surface of the slot 32.

The opposite or second exposed slot 34 is significantly wider than the first slot 32 and has an opposite end of the sharpening element 30 therein. More specifically, as shown in FIGS. 2 and 4, the sharpening element 30 has a flat planar exposed surface 48 exposed within the slot 34 between an adjacent side wall 50 of the slot 34.

In the operation of the hand-held ice skate sharpener, the hand-held device is first positioned into the position generally shown in FIG. 2 wherein the blade 12 is located within the slot 34 and is exposed to one surface of the sharpening element 30. In this position, a hand force, generally in the left-hand direction of FIG. 2, will force a parallel surface of the sharpening element 30 into engagement with the wall 16 to remove any burrs from the wall 16 of the blade 12. Reversal of the blade will remove any burrs from the opposite wall 16 of the blade 12.

In sharpening the cutting edges 18 of the blade 12, the blade 12 is inserted within the slot 32 and is positioned into engagement with one or the other of the side walls of the slot 32. Since the width of the slot 32 is substantially greater than the width of the blade 12, the convex surface 40 of the sharpening element 30 will engage the concave surface 20 only adjacent the cutting edge. Since the radius of the surface 40 of the sharpening element 30 is approximately one-half the radius of the concave surface 20 on the end of the ice skate blade 12, a true clear-cut cutting edge is defined when the sharpening device 10 is reciprocated back and forth across the end of the ice skate blade 12. Of course, it will be appreciated that the respective cutting edges 18 are sharpened by placing the respective side walls 16 against the respective side walls of the slot 32 so that sharp cutting edges are produced by the reciprocable motion of the hand-held sharpening device 10 with respect to the blade 12.

As can be appreciated from the above description, the present invention provides an extremely simplified hand-held ice skate sharpening device that can be manufactured at a minimal cost, and not only provides a sharpening device for the cutting edges of the an ice skate blade, but also provides a deburring device for the side walls of the ice skate blade leading to the respective cutting edges.

During the use of the sharpening device of the present invention, it is desirable to utilize a solution interposed between the surface of the blade to be sharpened and the adjacent surface of the sharpening device at all times. Thus, it is suggested that during each of the steps discussed above that a solution be introduced onto either the surface of the blade to be sharpened or the sharpening element before the operation is commenced.

It is also important to keep the sharpening edge of the sharpening element clean at all times. As shown in FIG. 5, the sharpening element, having its exposed surface 40 in the slot 32, normally accumulates some type of debris 62 on its exposed surface. To remove this undesirable debris 62, a swabbing element 70, having a generally convex exposed porous compressible element 70 located on the end thereof, is designed to be received into the slot 32 to remove the contaminates 62 from the exposed surface 40 of the sharpening element 30.

Of course, numerous modifications come to mind without departing from the spirit of the invention. For example, FIG. 2 of the drawings discloses the holder 24 supporting the sharpening element 30 as being two elements 24A and 24B interconnected through the use of suitable adhesives.

In the embodiment shown in FIG. 4, the two holder parts 24A and 24B are interconnected through the use of a screw 80 that has a tapered head 82 received into a tapered opening 84 in the portion 24B so that the exposed surface of the holder portion 24B is generally flat and can readily grasped by an operator.

While the specific embodiments have been illustrated and described, numerous modifications come to mind without significantly departing from the spirit of the invention and the scope of protection is only limited by the scope of the accompanying claims.

I claim:

1. A hand-held ice skate sharpener for a skate blade having a concave surface between two generally parallel side walls comprising a sharpener element having a generally rectangular configuration with two planar opposed surfaces and a convex surface along one edge between said opposed surfaces and a holder comprising a non-metallic elongated member having a first slot extending from one edge thereof, said first slot being closed along an opposite edge, said first slot having a width equal to the space between said opposed surfaces of said sharpener element to expose said convex surface of said sharpener element in said slot and expose portions of opposed walls of said slot for guiding said blade, said member having a second slot extending from said opposite edge and laterally offset from said first slot, said first and second slots having a common wall extending between the edges of said member and an opposed wall of said second slot being spaced from said common wall by a dimension greater than the spacing between said opposed surfaces of said sharpener element plus the spacing between said side walls of said blade to expose one planar surface of said sharpener element for engagement with one of said parallel side walls of said skate blade to remove burrs and chipped edges from one side wall of said skate blade.

2. A hand-held ice skate sharpener as defined in claim 1, in which said convex surface of said sharpener element defines an arcuate surface having a radius of about one-half the spacing between said opposed surfaces.

3. A hand-held ice skate sharpener as defined in claim 2, in which said concave surface has a radius greater than the radius of said arcuate surface of said skate blade and said first slot has a width greater than the spacing between said parallel side walls so that both edges adjacent respective side walls can be sharpened by said convex surface.

4. A hand-held ice skate sharpener as defined in claim 1, in which said common wall has a flange extending therefrom adjacent said opposite edge of said member for closing said first slot.

5. A skate blade sharpener for sharpening edges of a blade defined between opposed side walls and a concave edge wall, comprising a generally rectangular sharpening element having a convex edge with opposed, generally parallel surfaces extending from said convex edge and an elongated holder having first and second edges with first and second slots respectively opening towards said first and second edges, said first and second slots having a common wall, said sharpening element being received into said first slot and positioned therein to expose said convex edge in said first slot and a portion of opposed walls of said first slot for guiding said blade, said sharpening element having one of said parallel surfaces exposed in said second slot and defining one wall thereof with an opposite wall spaced from said common wall by a dimension greater than the spacing between said opposed surfaces of said sharpener element and spaced therefrom to receive said blade so that said skate blade can be received into said second slot to remove burrs from said side walls and can be received into said first slot to sharpen the respective edges of said blade.

6. A skate blade sharpener as defined in claim 5, in which said opposed walls of said first slot are spaced by a dimension equal to the spacing between said parallel surfaces of said sharpening element.

7. A skate blade sharpener as defined in claim 6, in which said opposed walls of said first slot and opposed walls of said second slot are spaced by a dimension greater than the spacing of said side walls of said blade.

* * * * *